United States Patent [19]

Romanin et al.

[11] Patent Number: 4,854,514

[45] Date of Patent: Aug. 8, 1989

[54] DEVICE AND METHOD FOR STORING AND RETURNING YARN DURING THE WINDING OF CONICAL BOBBINS FED WITH YARN AT CONSTANT SPEED

[75] Inventors: Bruno Romanin, Cordenons; Francesco Ferro, Pordenone; Luigi Colli, Pordenone, both of Italy

[73] Assignee: Savio, S.p.A., Pordenone, Italy

[21] Appl. No.: 170,278

[22] Filed: Mar. 18, 1988

[30] Foreign Application Priority Data

Mar. 19, 1987 [IT] Italy ..... 1975 A/87

[51] Int. Cl.[4] ..... B65H 54/06; B65H 54/10; B65H 59/22

[52] U.S. Cl. ..... 242/18 R; 242/18 DD; 242/150 R

[58] Field of Search ..... 242/18 DD, 18 R, 45, 242/147 R, 149, 150 R, 150 M, 154

[56] References Cited

U.S. PATENT DOCUMENTS

| | | | |
|---|---|---|---|
| 2,102,109 | 12/1937 | Brueggemann | 242/45 XR |
| 3,047,247 | 7/1962 | Kotte | 242/45 |
| 3,231,216 | 1/1966 | Lemarchand | 242/150 R |
| 3,300,161 | 1/1967 | Hermanns | 242/154 |

FOREIGN PATENT DOCUMENTS

| | | |
|---|---|---|
| 1334485 | 6/1962 | France . |
| 83273 | 3/1963 | France . |
| 2117575 | 7/1972 | France . |
| 2271162 | 12/1975 | France . |
| 2125072 | 2/1984 | United Kingdom . |

*Primary Examiner*—Stanley N. Gilreath

*Attorney, Agent, or Firm*—Hedman, Gibson, Costigan & Hoare

[57] ABSTRACT

A device and method for winding conical bobbins with yarn withdawn at constant speed from individual spinning units, and comprising: a deflecting roller, or similar element, which is connected to and moved backwards and forwards by a swinging arm which by storing and returning the yarn compensates for the different speeds at which the yarn is collected on the conical surface of the bobbin under formation wherein yarn is drawn into the storage position and is then released from this storage position, (i.e. returned). This returning operation releases the yarn from its storage position and replaces it (returns it), to its normal feed path; two proximity sensors positioned to define the regular range of swing of the yarn storage and return arm; an electronic control unit arranged to receive an electrical signal or several electrical signals provided by the proximity sensors when the yarn storage and return swings stray outside the regular range and arranged to generate, when said signals occur, an electrical control signal which activates a pressure variator; and a pressure variator which increases or decrease the pressure on a disc yarn tensioner in order to return the storage swing to within the range of values corresponding to regular storage.

4 Claims, 1 Drawing Sheet

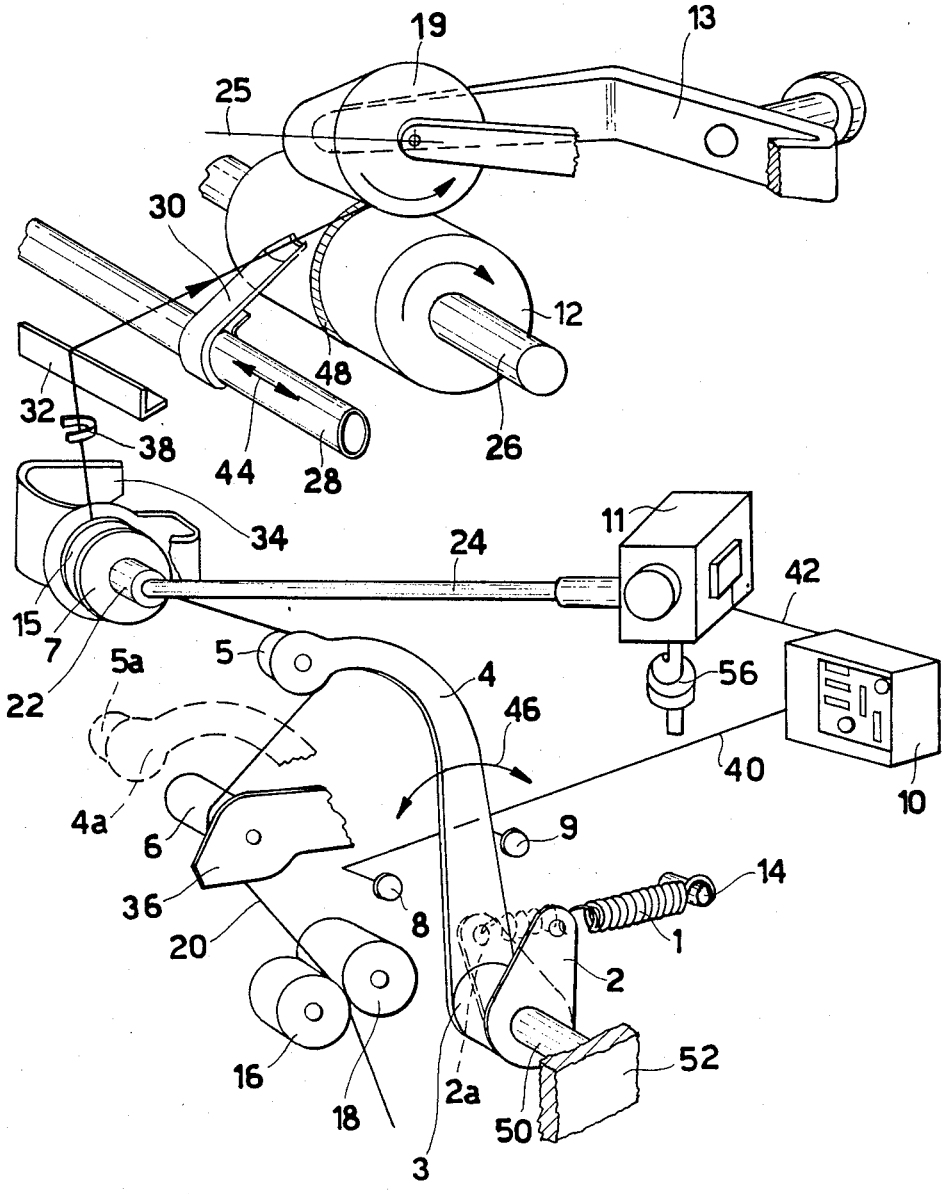
19
13
25
30
12
48
32
38
44
28
26
34
24
11
42
15
7
22
5a
5
4
56
46
40
10
4a
6
9
36
8
14
20
1
2
16
2a
52
18
50
3

DEVICE AND METHOD FOR STORING AND RETURNING YARN DURING THE WINDING OF CONICAL BOBBINS FED WITH YARN AT CONSTANT SPEED

The invention relates to a device and method for intermittently storing and returning yarn during the winding of conical bobbins with yarn withdrawn at constant speed from individual spinning units. In said spinning units, the yarn emerges at their outlet at constant speed from the feed rollers and must be deposited at a speed which varies between the major diameter and minor diameter of the conical bobbin being formed. In such an operational process it is therefore necessary to periodically vary the yarn length in the section between the feed rollers and its point of deposition on the circumference of the conical bobbin.

This length variation and the consequent variation in yarn tension are compensated by adjusting the yarn path by means of a regulator and compensator device for the tension acting on the yarn during the winding process. Said devices comprise a deflecting roller connected to a rocker arm. Depending on the instantaneous yarn tension, or rather according to the instantaneous position of the rocker arm, the mobile deflecting roller is deviated to a varying extent from its contact or bearing position, this position being assumed by the action of a force exerted by a counterweight, a spring or a similar elastic element. These yarn tension compensators have the drawback of exerting an elastic opposing force which cannot be controlled in respect of the tension variations which can occur in the yarn in the case of non-regular storage.

The conical bobbin under formation is driven by a constantly rotating substantially cylindrical drive roller. The dimensions of said bobbin, its taper and angle of the winding helix determine the angular swing amplitude of the mobile arm.

The swing position of this latter, which keeps a roller connected to it constantly adhering to the yarn, represents the yarn storage value, which constantly increases and decreases according to the stage in the progress of the entire yarn storage and return cycle. Any slippage between the control roller and bobbin under formation, which is frequently present due to the friction drive used, increases the length of yarn stored and changes the swing position of the mobile arm which, under the action of the elastic element acting in a pulling capacity, is moved in the limit into an abutting position, consequently nullifying the tensioning of the yarn being collected. Thus without tension, this latter winds with irregular turns, so prejudicing the bobbin formation and in the limit the yarn leaving the feed rollers twists about itself to create loops and tangles such as to compromise the yarn consistency.

The tangled yarn also frequently creates obstacles such as to interrupt yarn continuity, so blocking the spinning process. The high yarn formation rate of spinning units means that any production hold-up in such spinning units assumes considerable importance because of the reduced rate of yarn collection on the bobbin.

Yarn tension compensators of this type also have the drawback that if the yarn count or thickness, the type of bobbin under formation or the winding helix angle varies, they have to be adapted to this by onerous manual adjustments to the individual spinning stations, or by replacing the elastic element with another elastic element which conforms to the different operating characteristics. These devices are therefore inflexible in use.

Devices for intermittently storing end returning yarn, preferably for textile machines, are also known. These include by way of example the devices described and claimed in the German patent Nos. DE 1785153 and DE 1454917.

Such devices have numerous drawbacks: they are insensitive to tension and even less to tension variations in the winding yarn because the storage and return element is of a type which, by means of a lever system, is completely controlled by a to-and-fro drive rod which passes along the entire machine to operate the yarn stores of all the spinning units. They are unable to adjust the yarn tension to one or more predetermined values preset according to the type of yarn being collected or of the bobbin under formation. They present considerable difficulty in adjusting the value preset for the storage of the yarn being wound, as this adjustment must be made manually by an operator by adjusting the length of the connecting rods or the positions of the lever rotation pivots in order to vary the lever arms, and is therefore lengthy, laborious and variable according to the type of bobbin under formation and the winding helix angle; they also have a rather high inertia force due to the presence of several lever systems which are mobile simultaneously but intermittently, and tend to trigger uncontrollable vibratory oscillation and at the same time limit the collection rate. They also set limits on the machine length and therefore on the number of spinning units as their operation relies on drive rods which have to extend along the face of the collection units and are subjected to large numbers of to-and-fro movement strokes. These devices are also rather bulky and inefficient when slippage is present between the conical bobbin under formation and the drive roller. This slippage, which is more or less accentuated, is often present because a conical bobbin being cross-wound continuously rests against a drive roller which on a determined but narrow part of its surface possesses a friction band for friction drive purposes. A further drawback of such devices is the presence of mobile members, such as rods or shafts, which have to be provided and mounted at the commencement of machine construction, and cannot be enomomically fitted later.

Said mobile members control the operation of several storage devices and extend along the entire winding face from a position at the head of the machine. Because of the principle on which they are constructed, these devices are therefore inflexible and unadaptable to pre-existing spinning stations or stations not provided with the aforesaid mobile members which pass along the front structure of the entire collection face.

An object of the present invention is to obviate the aforesaid drawbacks by providing a storage and intermittent return device wherein yarn is drawn into the storage position, (i.e. returned). This returning operation releases the yarn from its storage position and replaces it (returns it), to its normal feed path. This device, winding conical bobbins fed with yarn at constant speed has the following advantages:

enables the stored length to be always maintained within a preset range of values with only limited variations in yarn tension allows the immediate takeup of any additional yarn lengths accidentally present due to slippage between the drive roller and conical bobbin under formation does not limit the yarn collection speed in the formation of conical bobbins does not set limits on the machine length and thus does not limit the number of winding units to be positioned side by side, as these do not require for their operation any drive member extending along the entire winding face, and therefore do not possess further masses moving longitudinally to the machine and connected to central drive members does not limit the diameter of the bobbins obtainable and does not require laborious adjustment to be made when changing the taper of the bobbin under formation has extreme operational flexibility such as to allow a range of application which enables soft or compact bobbins to be made up within a vast range of yarn counts without the need for laborious mechanical adjustments can be applied without the need for extensive demounting and remounting of the component parts of the winding machine if this, being already set for forming cylindrical bobbins, is to be converted for forming conical bobbins can be easily disengaged so as to make it possible to form both conical and cylindrical bobbins on the same machine.

A further object of the present invention is to provide a yarn storage and return device which requires very little maintenance. These and further objects are all attained by the yarn storage and return device of the present invention, in particular for textile machines operating to form conical bobbins, characterised by comprising:

a lever system with two suitably shaped and positioned flat elements, and being able to move with swing motion about an axis by means of a bush positioned as a rigid element joining together said flat elements, of which one acts, in union with a deflecting roller, as a yarn storage and return arm and, at the same time, as a tension compensator and regulator element for the yarn being wound, and the other flat element acts as an attachment and connection element for the mobile end eyelet of a helical elastic element subjected to traction, in order to generate an opposing force which balances the force produced by the tension of the yarn being wound two proximity sensors or similar elements, positioned to define the regular range to swing of the yarn storage and return arms, and able to generate an electrical signal or a series of electrical signals when the yarn storage and return swing movements stray outside the predetermined preset regular range as electronic control unit, of known type, which receives said electrical signal or said series of electrical signals provided by the proximity sensors and processes them in order to generate an electrical control signal which activates a pressure variator a pressure variator arranged to increase or decrease, under the influence of said control signal, the pressure on the disc yarn tensioner in order to adjust the tension of the yarn being wound to a value which is slightly higher or slightly lower than the previous value so as to rapidly restore the storage swing to within the range of values corresponding to regular storage. Thus, the yarn is drawn into the storage position when the tension is low and subsequently released from this storage position, i.e. returned, when the tension is high. This returning operation releases the yarn from its storage position and replaces it (returns it), to its normal feed path.

According to one embodiment, the device is present individually in each yarn winding position. According to a further embodiment, the device has no mechanical link with the yarn guide element or with the support arm for the bobbin under formation, and is therefore independent of the fullness of the bobbin itself.

The device according to the invention has the advantage, for any variation in the type of yarn and for any variation in the geometrical characteristics of the winding or of the bobbin under formation, of automatically adjusting and setting the tension of the yarn being collected, to thus obtain storage and return swing motion which lies within the regular range defined by the two proximity sensors.

A further advantage of the device is that it ensures that once adjusted to the value corresponding to regular storage swing motion, the pressure on the disc yarn tensioner remains constant so as not to minimally vary the tension of the yarn being continuously wound onto the conical package.

A preferred embodiment of the device of the present invention is described hereinafter by way of non-limiting example with reference to the single accompanying FIGURE.

This is a diagrammatic isometric view of the intermittent storage and return device of the present invention cooperating with the yarn guide element, the bobbin under formation being driven by the friction band of the drive roller, the FIGURE showing the moment of maximum storage in the yarn travel while the yarn guide element is moving in the increasing diameter direction of the cross-wound bobbin.

In the single FIGURE, the reference number 1 indicates the helical elastic element which is subjected to traction to generate an opposing force for balancing the force produced by the tension in the yarn being wound; 2 is the mobile flat element which acts as an attachment and connection element for the eyelet of the helical elastic element 1; *2a* is the position which the flat element 2 assumes at that moment during its swing movement when the stored length of yarn 20 is zero or a minimum; 3 is the bush or ring which rigidly joins together the two flat elements 4 and 2 of the yarn storage and return lever system; 4 is the flat element which in union with a deflection roller 5 acts as the storage and return arm for the yarn 20 while also acting as the tension compensation and adjustment element for the yarn 20 being wound; *4a* is the position which the mobile flat element 4 assumes at that moment during its swing movement when the stored length of yarn 20 is zero or a minimum; 5 is a deflecting roller or similar element which acts as a mobile yarn guide with swing movement in the storage and return of the yarn 20. It is rigid with the end of the mobile flat element 4 but is able to rotate about itself so as not to generate grazing friction against the yarn 20 undergoing continuous collection. It has a substantially cylindrical profile; *5a* is the position which the mobile yarn deflecting and guide roller 5 assumes at that moment during its swing movement when the stored length of yarn 20 is zero or a minimum; 6 is a fixed yarn deflecting and quide roller having a substantially cylindrical profile and connected rigidly to the base plate 36 but free to rotate about itself to not generate grazing friction against the yarn 20 undergoing continuous collection movement; 7 is a yarn tensioner disc or washer able both to rotate idly about its axis of rotation and to translate axially. Said disc compresses the yarn and thus tensions it by the effect of the force exerted by a piston operated by the pressure of a fluid; 8 is a proximity sensor or similar element positioned to define the minimum storage end of the regular range of swing of the yarn storage and return arm 4; 9 is the proximity sensor or similar element positioned to define the end corresponding to maximum storage; 10 is an electronic control unit of known type arranged to receive the electrical signals provided by the proximity sensors 8 and 9 and to generate a control electrical signal which activates the pressure variator 11; 11 is a pressure variator arranged to increase or reduce the pressure on the disc yarn tensioner; 12 is the drive roller for rotating the conical bobbin 19 under formation; 13 is the bobbin carrier arm supporting the yarn package 19 as its diameter gradually increases; 14 is the connection pin for connection to the fixed eyelet of the helical elastic element 1; 15 is a yarn tensioner disc or washer arranged rotate idly about a fixed axis of rotation but not necessarily susceptible to axial movement, it facing the disc 7; 16 and 18 indicate a pair of rollers positioned along the path of the yarn 20, both rollers being pressed against each other with said yarn 20 passing between them to withdraw it from a spinning unit of a rotor spinning machine and feed it from its outlet towards the compensator device of the present invention at constant speed; 19 is the cross-wound conical bobbin under formation; 20 is the collected yarn subjected to storage and return at the outlet of the pair of feed rollers 16 and 18; 22 is the actuator member which provides the compression thrust on the disc 15 in order to subject the yarn being wound to a tension which is appropriate for obtaining storage and return swing movements lying within the range of values corresponding to regular storage, as defined by the proximity sensors 8 and 9; 24 is the pressurised fluid pipe which connects the actuator member 22 of the pressure variator 11; 26 is the drive shaft which extends along the entire winding face; 28 is a hollow or solid shaft of circular cross-section which is operated as a control rod for the yarn guide elements 30 by means of a suitably shaped cam for transmitting motion of appropriate kinematic and dynamic characteristics to said yarn guide elements 30; 30 is the yarn guide element driven with reciprocating to-and-fro motion by the drive shaft or rod 28, this latter extending along the entire operational winding face; 32 is a blade for deflecting the path of the yarn 20 and can be linear or shaped with more or less accentuated profiles already known to the art; 34 is the disc yarn tensioner support, connected to the structure of the winding unit, not shown in the figure; 36 is the base plate for the roller 6, fixed to the machine structure, not shown in the figure; 38 is a fixed element for guiding the yarn 20 in its movement of collection onto the package 19; 40 is the connection cable between the proximity sensors 8 and 9 and the electronic control unit 10; 42 is the connection cable between the electronic control unit 10 and the pressure variator 11; 44 indicates the reciprocating to-and-fro movement path of the shaft 28; 46 represents the swing path of the mobile flat element 4; 48 is the friction region in the form of a narrow band for driving a conical bobbin by the drive roller 12; 50 is a shaft or pivot about which the intermittent storage and return lever system for the yarn 20 swings on the bush coupling 3; 52 is the base plate which supports the pivot 50 and is fixed to the machine structure; 56 is the passage pipe for the operating fluid required for operating the actuator member 22 which generates the thrust for tensioning the yarn 20 being wound. The operation of the device according to the invention is as follows.

The purpose of the device according to the invention is to adapt the varying winding speed deriving from the taper of the bobbin 19 to the constant outlet speed of the yarn from the feed rollers 16 and 18. The average winding speed must correspond substantially to the speed of extraction of the yarn from the spinning unit. When the yarn 20 is being collected on the minor diameter of the conical bobbin 19 the winding speed is less than the feed speed from the extracting rollers 16 and 18, and the lever system by means of its mobile flat element 4 stores a suitable length of yarn 20.

This stored length is returned gradually as the collection speed increases on moving the yarn 20 towards the major diameter of the bobbin 19 by means of the yarn guide element 30.

The ratio of the minor diameter to the major diameter of the bobbin 19 under formation determines the maximum length of yarn 20 which has to be stored and then returned for each complete transverse cycle of the yarn guide element 30. As said ratio decreases continuously with increasing fullness of the bobbin 19 under formation, the amplitude of the swing movement of the mobile yarn deflecting and guide roller 5 also decreases for decreasing storage of yarn 20.

The mobile deflecting roller 5 generates a loop by deflecting the yarn 20 from its path. This loop therefore has a continuously varying amplitude and the device of the present invention is automatically controlled in accordance with this variation, to act as a compensator for the periodic tension variations which arise as a result of the periodic winding speed variations in the formation of a conical bobbin 19.

In order to compensate said tension variations to which the collected yarn 20 is subjected and level them out to a substantially constant value, the mobile deflecting roller 5 has to assume different positions relative to the fixed deflecting roller 6. Because of the rigid connection, this variation in the position of the mobile deflecting roller 5 also corresponds to the swing of the two flat elements 4 and 2. The flat element 2 acts as the attachment and connection element for the end eyelet of a helical elastic element 1 which, urged by traction, generates a return force such as to oppose the force produced by the tension in the yarn being wound. Because of the rigid connection between the two flat elements 4 and 2 provided by the connection bush 3, said opposing action produces balance at the storage roller 5 at every moment between the elastic return force and the force produced by the tension in the yarn 20 being wound. The effect of the periodic variation in the winding speed of the yarn 20 on the conical bobbin 19 is a variation in the yarn tension. This latter tension variation is stabilised about the average value of the elastic return force of the elastic element 1 which is subjected to oscillating deformation between two positions to which the swing positions of the flat element 4 and storage roller 5 perfectly correspond. If during the continuous winding process the storage and return swings remain within the predetermined limits set by the positioning of the two proximity sensors 8 and 9, said sensors do not generate any electrical signal and the electronic control unit 10 remains deactivated while the storage and return cycles of the yarn 20 remain regular. Thus no activation signal for the pressure variator 11 is generated at the output of the electronic control unit 10, and is therefore not fed. If during the continuous winding process the storage and return swings stray outside the predetermined limits set by the positioning of the two proximity sensors 8 and 9, said sensors generate an electrical signal or a series of electrical signals, and these are fed through the connection cable 40 and received by the electronic control unit 10.

On receipt of said electrical signals this latter instantaneously provides at its output an electrical control signal which activates the pressure variator 11. Under the action of said control signal, the pressure variator 11 increases or decreases the pressure on the yarn tensioner discs 7 and 15 through the connection pipe 24, in order to adjust the tension of the yarn being wound to a value slightly higher or lower than the previous value. The storage and return swing motion is therefore rapidly restored to within the range of values corresponding to regular storage as defined by the proximity sensors 8 and 9. This latter operation can be further clarified as follows. If the mobile deflecting roller 5 causes the loop in the yarn 20 to assume a position which exceeds the maximum storage limit allowed by the position of the contact sensor 9, which defines one end of the regular range, said sensor 9, because the flat element 4 is present in front of its, generates an electrical signal or a series of electrical signals which are fed through the connection cable 40 to the electronic control unit 10.

This latter, after identifying the type of electrical signal received from the proximity sensor 9, correspondingly produces at its output a specific electrical control signal, which is fed through the connection cable 42 to activate the pressure variator 11, which reduces the pressure of the operating fluid and therefore, by way of the connection pipe 24 and actuator member 22, reduces the pressure on the yarn tensioner discs 7 and 15. Consequently the tension in the yarn 20 being wound settles at an average value which is slightly less than the previous average value.

Said reduction in the average tension of the yarn 20, which is under continuous winding, must be sufficiently gradual to not allow the formation of tangles, knots or similar defects which if collected on the bobbin would reduced its quality. By reducing only slightly the average tension of the yarn 20 being wound, the yarn slackens and becomes less embedded into the already deposited layers of yarn, and continues its winding in the form of turns of slightly increased diameter.

Such turns result in rapid and progressive takeup of the excessive storage created by a multiplicity of factors. If the mobile deflecting roller 5 causes the loop in the yarn 20 to assume a position which lies below the minimum storage limit allowed by the position of the contact sensor 8, which defines one end of the regular range, said sensor 8, because the flat element 4 is present in front of it, generates an electrical signal or a series of electrical signals which are fed through the connection cable 40 to the electronic control unit 10.

This latter, after identifying the type of electrical signal received from the proximity sensor 8, correspondingly produces at its output a specific electrical control signal, which is fed through the connection cable 42 to activate the pressure variator 11, which rapidly increases the pressure of the operating fluid. This latter, by way of the connection pipe 24 and actuator member 22, increases the pressure on the yarn tensioner discs 7 and 15. Consequently the tension in the yarn 20 being wound settles at an average value which is slightly greater than the previous average value. Said increase in the average tension of the yarn 20, which is under continuous winding, can be substantially rapid as there is no danger of the formation of tangles, knots or similar defects.

By increasing only slightly the average tension of the yarn 20 being wound, the yarn tightens and becomes more embedded into the already deposited layers or yarn, and continues its winding in the form of turns of slightly decreased diameter. These turns rapidly and progressively causes the yarn to be stored in a progressively increasing loop, and the intermittent swing of the mobile flat element 4 is restored to within the limits of the predetermined regular range set by the positions of the sensors 8 and 9. The amplitude of the regular range is predetermined and preset by the geometrical characteristics of the winding being made and the geometrical characteristics of the conical bobbin 19 under formation.

It has found that the device for intermittently storing and returning yarn during the winding of conical bobbins fed with yarn at constant speed, according to the present invention, acts very reliably and periodically compensates the variations in yarn tension within the mobile deflecting roller 5 undergoing uncontrollable swing.

The use of the device according to the invention is not limited to the winding of conical bobbins produced on spinning units, but can also be advantageously applied to the winding of conical bobbins or packages on any winding unit.

A preferred embodiment has been described herein but it is apparent that other embodiments are possible which fall within the scope of the present invention.

Thus the positions of the operating lever systems can vary; different drive arrangements can be provided; it is also possible to vary the shapes and dimensions of the mobile yarn deflecting roller 5 and fixed deflecting roller 6 together with the two flat elements 4 and 2 which undergo swing movement; ratios and dimensions of the various operational elements can also vary such as the discs 7 and 15 of the yarn tensioner and the elastic element 1; modifications of a practical applicational nature can be made; thus for example the position of the storage lever system can be sensed by an optical rod or bar, or by one or more optical sensors in cooperation with bar codes; this latter position, which is converted into an electrical signal and processed as heretofore described, can also be sensed on a circumferential arc close to or in correspondence with the axis of rotation of the storage lever system so as not to be influenced by and small vibrations set up by yarn passage. Obviously the various processed signals can be functions of other physical quantities related to the aforesaid, in that the arrangement of the various units of the device can be easily modified according to the various types of quantities to be processed or compared. Numerous modifications can be made to the present invention thus conceived, all of which fall within the scope of the inventive concept. Moreover, all details can be replaced by other technically equivalent elements; all without leaving the scope of the inventive idea as claimed hereinafter.

We claim:

1. A yarn storage and return device for yarn being wound on a conical bobbin driven at a constant speed comprising:

(a) a lever system including a shaft, an elastic element, and a pair of arms which are connected to and move with each other, through which said shaft passes, and which can swing around the axis defined by said shaft, one of said arms having a deflecting roller and acting as a yarn storage and return means and a tension compensator and a regulator for the wound yarn, and the other of said arms being connected to said elastic element for generating a balancing counterforce to the tension of said wound yarn;

(b) sensing means for sensing the position of said storage and return arm, which define a predetermined preset swing range of said yarn storage and return arm for generating one or more electrical signals when the range of swing of said storage and return arm deviates from said preset range;

(c) an electronic control processor unit for receiving and processing said electric signal from said sensing means for generating a control signal;

(d) a disc yarn tensioner for adjusting the tension of the yarn being wound; and (e) a pressure variator operatively connected to said disc yarn tensioner for increasing or decreasing the pressure on said disc yarn tensioner for restoring the range of swing of said storage arm to within the preset range defined by said positional sensors.

2. The device of claim 1, wherein the elastic element is helical.

3. In an apparatus for winding yarn on a conical bobbin driven at a constant speed, including a guide for guiding the yarn onto the bobbin, a support for supporting the bobbin, and a measurer of the fullness of the bobbin, a device for storing and returning yarn being wound on the bobbin independent of said guide, said support, or fullness of the bobbin, wherein the device comprises:

(a) a lever system including a shaft, an elastic element, and a pair of spaced apart arms which are rigidly joined by a bushing, through which said shaft passes, and which can swing around the axis defined by said shaft, one of said arms having a deflecing roller and acting as a yarn storage and return means and a tension compensator and a regulator for the wound yarn, and the other of said arms being connected to said elastic element for generating a balancing counterforce to the tension of said wound yarn;

(b) sensing means for sensing the position of said storage and return arm, which define a predetermined preset swing range of said yarn storage and return arm for generating one or more electrical signals when the range of swing of said storage and return arm deviates from said preset range;

(c) an electronic control processor unit for receiving and processing said electric signal from said sensing means for generating a control signal;

(d) a disc yarn tensioner for adjusting the tension of the yarn being wound; and (e) a pressure variator operatively connected to said disc yarn tensioner for increasing or decreasing the pressure on said disc yarn tensioner for restoring the range of swing of said storage arm to within the preset range defined by said positional sensors.

4. A method for storing and returning yarn being wound on a conical bobbin driven at a constant speed comprising the steps of:

(a) driving a lever system means having a storage and return arm means for storing and returning yarn, for generating a balancing counterforce to the tension of said wound yarn;

(b) sensing the position of said storage and return arm means of said lever system for defining a predetermined preset swing range of said arm for generating one or more electrical signals when the range of swing of said arm deviates from said preset range by one or more position sensing means;

(c) receiving and processing said electrical signal from said sensing means and generating a control signal by an electronic control processor unit means.

(d) adjusting the tension of the yarn being wound by a disc yarn tensioner means;

(e) increasing or decreasing the pressure on said disc yarn tension means for restoring the range of swing of said storage and return arm to within the preset range defined by said positional sensor means by a pressure variator means.

* * * * *

UNITED STATES PATENT AND TRADEMARK OFFICE

CERTIFICATE OF CORRECTION

PATENT NO. : 4,854,514

DATED : August 8, 1989

INVENTOR(S) : Bruno Romanin et al.

It is certified that error appears in the above-identified patent and that said Letters Patent is hereby corrected as shown below:

Title page, Foreign Application Priority Data, change

"1975 A/87" to -- 19758A/87 --.

Signed and Sealed this

Tenth Day of July, 1990

*Attest:*

HARRY F. MANBECK, JR.

*Attesting Officer*

*Commissioner of Patents and Trademarks*